United States Patent [19]

Colombo

[11] 4,031,949

[45] June 28, 1977

[54] WATER COOLED MOLD FOR THE CONTINUOUS CASTING OF METALS

[76] Inventor: Piero Colombo, 27, Via Leopardi, Udine, Italy

[22] Filed: Apr. 23, 1976

[21] Appl. No.: 679,316

[30] Foreign Application Priority Data

Apr. 28, 1975 Italy ..... 12587/75

[52] U.S. Cl. ..... 164/283 M

[51] Int. Cl.[2] ..... B22D 11/02

[58] Field of Search ..... 164/89, 283 M

[56] References Cited

UNITED STATES PATENTS

| | | | |
|---|---|---|---|
| 1,444,953 | 2/1923 | Crane | 164/283 M X |
| 3,170,204 | 2/1965 | Tarmann | 164/283 M X |
| 3,313,006 | 4/1967 | Barbe et al. | 164/283 M |

FOREIGN PATENTS OR APPLICATIONS

| | | | |
|---|---|---|---|
| 1,031,936 | 6/1958 | Germany | 164/283 M |
| 25,544 | 12/1967 | Japan | 164/283 M |

*Primary Examiner*—Robert D. Baldwin
*Attorney, Agent, or Firm*—Larson, Taylor and Hinds

[57] ABSTRACT

A mold for the continuous casting of molten steel comprising an inner tubular mantle surrounded by an outer tubular mantle, leaving between them a cooling jacket for the flow of cooling water. The mold is surrounded, starting from its lower end, and up to substantially one half of its height, by an outer, funnel shaped mantle, defining in cooperation with the outer mantle of the mold, a cooling water inlet manifold, the cross sectional area of the flow passage of which is decreasing from its upper end to its lower end. The said cooling water inlet manifold communicates at its lower end through suitable ports with the lower end of the cooling jacket of the mold, while at its upper end it communicates with the cooling water supply pipes. The upper end of the mold is surrounded by an outer, funnel shaped, mantle defining in cooperation with the outer mantle of the mold an outlet manifold, the cross sectional area of the flow passage of which is increasing from its upper end to its lower end. The said cooling water outlet manifold communicates at its upper end through suitable ports with the upper end of the cooling jacket of the mold, and at its lower end it communicates with an exhaust chamber disposed above the water inlet manifold and communicating with the cooling water exhaust pipes.

1 Claim, 2 Drawing Figures

WATER COOLED MOLD FOR THE CONTINUOUS CASTING OF METALS

BACKGROUND AND SUMMARY OF THE INVENTION

This invention relates to tubular molds for the continuous casting of molten metals, provided with an outer cooling water jacket for the cooling of the tubular inner mantle of the mold inside of which the solidification of the continuous cast ingot begins.

A main problem arising in the molds of the above described kind, is that of obtaining a uniform distribution of the flow of the cooling water in the cooling jacket. In fact, since the overall heat transmission coefficient from the molten metal to the cooling water through the inner mantle of the mold depends essentially on the flow rate of the cooling water in the cooling jacket, it is hence necessary that the said flow rate be substantially equal all around the whole periphery of the inner mantle of the mold. In fact, in the absence of such an uniform distribution of the flow rate of the cooling water in the cooling jacket, the heat exchange intensity between molten metal and water will vary from location to location even in the same peripheral zone of the inner mantle of the mold, which has as a consequence differences in the thickness of the outer solidified metal layer of the ingot being formed, the so called "crust", which crust has to withstand the ferrostatic pressure exerted by the molten core of the ingot, until completion of the solidification of the ingot.

The above differences in the thickness of the crust of the ingot are the chief cause of deformations in the cross section of the cast ingots. They may also be the cause of breakages of the crust of the ingot, with the consequent need of interrupting the casting process, due to the outflow of liquid metal from the core of the ingot being formed.

In the known tubular molds of this kind, the cooling water was fed to the cooling jacket of the mold by means of feed pipes opening into small manifolds disposed at the inlet end of the cooling jacket.

The above and other similar prior art solutions are rather complicated, whilst they do not assure the perfect uniformity of flow of the cooling water through the cooling jacket of the mold.

It is accordingly the main object of the present invention to provide a water cooled tubular mold for the continuous casting of metals, in which the flow rate of the cooling water through the cooling jacket of the mold is uniform.

According to a main aspect of the present invention, the above object is accomplished by providing, between the cooling water feed pipes and the cooling water inlet ports of the cooling jacket of the mold, an inlet manifold chamber which on its side near the outlet ports of the feed pipes has a cross sectional area greater than the sum of the cross sectional areas of the cooling water feed pipes outlets, the cross sectional area inlet manifold chamber decreasing from the said side toward its opposite side in which the inlet ports of the cooling jacket of the mold are formed.

Preferably, the said inlet manifold chamber is formed by a funnel shaped mantle, surrounding the lower end of the cooling jacket of the mold, and extending from the lower end of the mold up to substantially one half of its height, where it is closed by an end plate provided with openings through which the outlet ends of the cooling water feed pipes are conducted. The above and other features and advantages of the present invention will be better evident from the following specification made with reference to the accompanying drawings.

DESCRIPTION OF THE PREFERRED EMBODIMENT OF THE INVENTION

Figure 1:
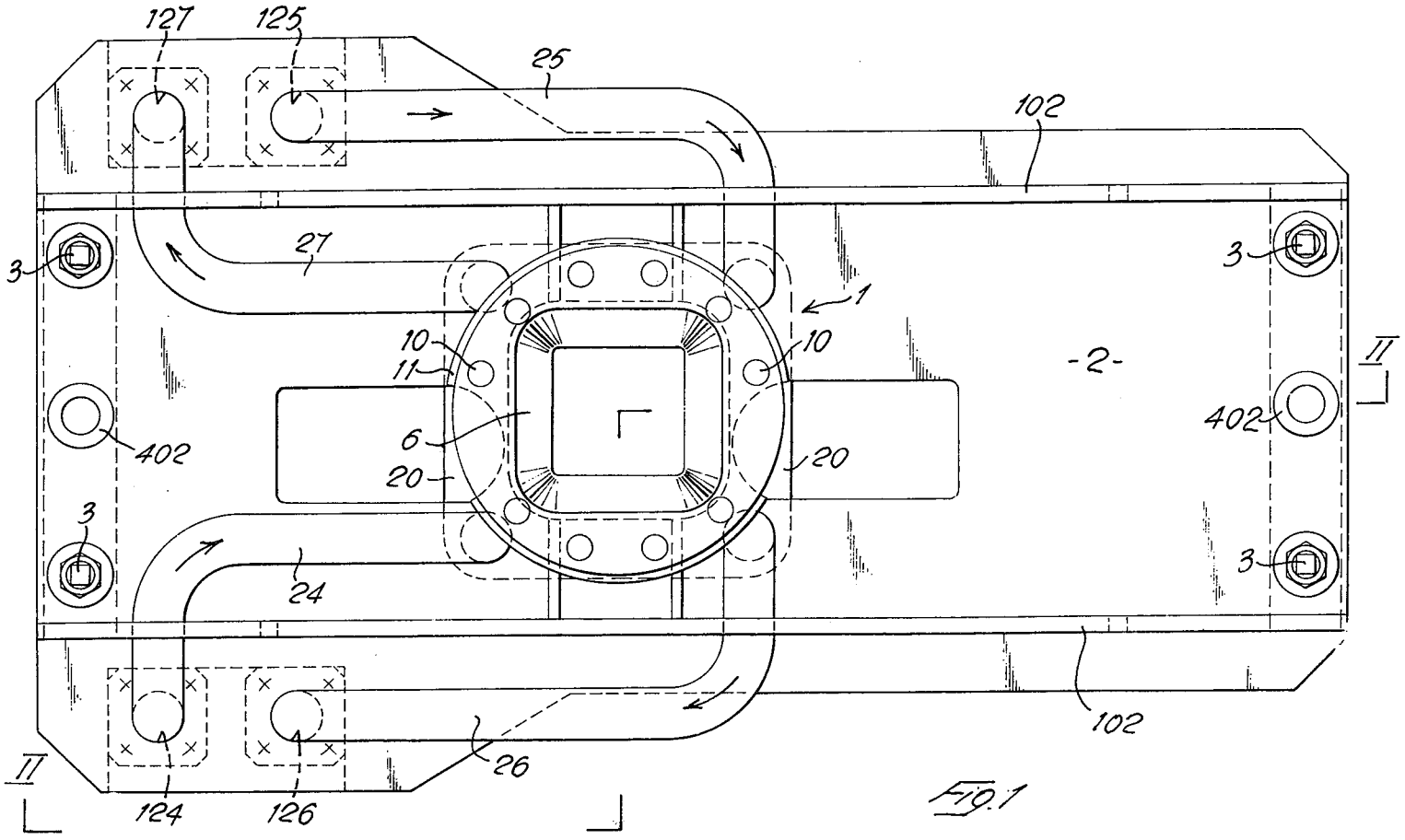
FIG. 1 is a top plan view of a continuous casting plant mold support table, provided with a water cooled mold according to the invention.
Figure 2:
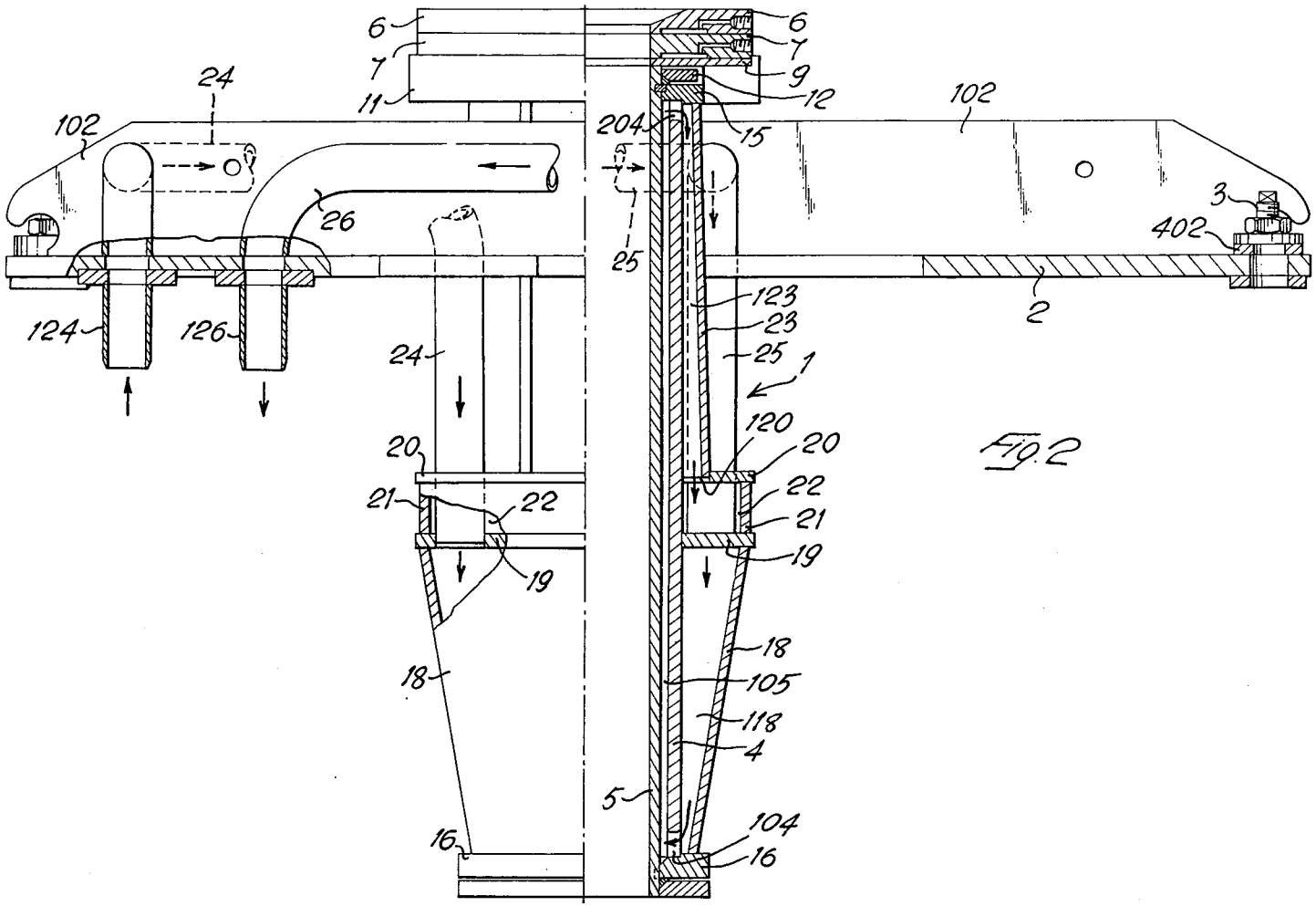
FIG. 2 is a side view, with parts broken away, and sectioned along lines II—II of FIG. 1, of the mold support table and of the mold of FIG. 1.

With reference to the drawings, numeral 2 denotes the support table for the mold 1 of a continuous casting plant. The said table 2 is provided with longitudinal reinforcing ribs 102, extending the whole length of the table 2, at a certain distance from its longitudinal edges.

Centrally at both ends of the table 2, the hubs 402 are formed in the table 2, for securing the said table to the frame of the continuous casting plant. At both sides of the hubs 402 the adjusting screws 3 are secured to the table 2.

The tubular mold 1 is inserted through a boring formed centrally in the table 2, and is supported by the said table in a known manner. The said mold 1 comprises an outer tubular mantle 4 and an inner tubular mantle 5, the outer diameter of which is smaller than the inner diameter of the tubular mantle 4, so as to leave between them an annular flow passage 105 for the cooling water.

To the upper end of the mold 1 there are secured, in a known manner, an annular flange 6 provided in its inside with a feed manifold for a suitable gas, an annular flange 7 provided with a feed manifold for a suitable lubricating oil, and an annular distance piece 9. The flanges 6 and 7 and the distance piece 9 are secured together and to the centering flange 11 by means of screws 10.

At the lower end of the mold 1, around the mantle 4 a frustro conical mantle 18 is mounted, extending from the lower closure flange 16 upwardly and outwardly up to about one half of the height of the mold 1, thus defining between the mantle 4 and the mantle 18 an inlet manifold chamber 118. The chamber 118 is closed at its upper end by an annular plate 19, and communicates at its bottom through ports 104 formed in the bottom end of the mantle 4, with the cooling jacket 105.

To the upper side of the plate 19, along the outer periphery of this plate, a cylindrical mantle 21 is secured, concentrically to the mold 1. The said mantle 21 extends upwardly for a short height, and is closed at its upper end by an annular plate 20, similar to plate 19, so as to define an exhaust chamber 22. Around the upper portion of the mold 1, a frustro conical mantle 23 is disposed, extending from the upper closure flange 15 downwardly and outwardly up to the plate 20. In this manner, between the inner side of the mantle 23 and the confronting portion of the outer side of the mantle 4 an outlet manifold chamber 123 is defined, communicating at its upper end through ports 204 formed in the upper end of the mantle 4 with the cooling jacket 105. The said outlet manifold chamber 123 further communicates through openings 120 formed in the closure plate 20, with the interior of the exhaust chamber 22.

24 and 25 are the cooling water feed pipes. The said feed pipes 24 and 25 are connected at their ends 124 and 125 to suitable cooling water feed sources (not shown), whilst their other ends extend, through openings formed in the table 2, in the plates 20 and 19, up to the inlet manifold chamber 118 inside of which the said feed pipes open.

26 and 27 are the cooling water exhaust pipes, communicating at one end with the interior of the exhaust chamber 22, through corresponding openings formed in the plate 20, whilst at their other ends 126 and 127 they are connected to suitable exhaust means manifolds for the used cooling water (not shown).

OPERATION OF THE DESCRIBED EMBODIMENT

In operation, the table 2 is secured, through the hubs 204, to the rocking frame of the continuous casting plant (not shown). the pipe unions 124, 125, 126 and 127 are connected to the respectives cooling water feed source and exhaust means. During the molding operation of the ingot being cast in the mold 1, the cooling water flows through pipes 24 and 25 in the inlet manifold chamber 118, and from this chamber 118 downwardly through the ports 104 formed in the lower end of the mantle 4, into the cooling jacket 105, where it flows upwardly into heat exchange relation with the tubular mantle 5 up to the upper end of the mold 1. The cooling water in the cooling jacket 105 is thereafter discharged through the ports 204 formed in the upper end of the mantle 4, into the outlet manifold chamber 123, and from this chamber it is discharged through the openings 120 in plate 20, into the exhaust chamber 22, from which it is exhausted through pipes 26 and 27.

Due to the progressive reduction of the cross sectional area of the flow passage of the inlet manifold chamber 118, the water flow rate at the inlet end of the cooling jacket 105 is uniform, and also the flow rate through the said cooling jacket is uniform. The said uniformity of flow through the cooling jacket is further assured by the provision, upstream of the exhaust chamber 22, of the outlet manifold chamber 123 provided with a flow passage having a progressively increasing cross sectional area from the ports 204 to the ports 120.

I claim:

1. A mold for the continuous casting of molten metals comprising an inner tubular mantle, an outer tubular mantle surrounding said inner tubular mantle leaving between them a cooling jacket for the flow of cooling water, an outer, funnel shaped mantle surrounding the said outer mantle of the mold from the lower end of the mold up to substantially one half of its height, defining in cooperation with the outer mantle of the mold a cooling water inlet manifold chamber the cross sectional area of the flow passage of which is progressively decreasing from its upper end to its lower end, communication ports formed in the said outer tubular mantle of the mold placing in communication the lower end of said water inlet manifold chamber with the lower end of said cooling jacket of the mold, cooling water supply pipes communicating with the upper end of said water inlet manifold chamber, a second, funnel shaped mantle surrounding the upper end of the mold, and defining in cooperation with the outer mantle of the mold a a water outlet manifold chamber, the cross sectional area of the flow passage of said water outlet manifold chamber being progressively increasing from its upper end to its lower end, communication ports formed in the said outer tubular mantle of the mold placing in communication the upper end of said water outlet manifold chamber with the upper end of said cooling jacket of the mold, and communication ports formed in the lower end of said water outlet manifold chamber placing in communication said water outlet manifold chamber with a water exhaust chamber communicating with the used cooling water exhaust pipes of the continuous casting plant.

* * * * *